US007976719B2

(12) United States Patent
Batz-Sohn et al.

(10) Patent No.: US 7,976,719 B2
(45) Date of Patent: Jul. 12, 2011

(54) USE OF A CATIONIC SILICON DIOXIDE DISPERSION AS A TEXTILE FINISHING AGENT

(75) Inventors: Christoph Batz-Sohn, Hanau (DE); Wolfgang Lortz, Waechtersbach (DE); Heinz Lach, Rodenbach (DE); Gabriele Perlet, Grosskrotzenburg (DE); Werner Will, Gelnhausen (DE)

(73) Assignee: Evonik Degussa GmbH, Essen (DE)

( * ) Notice: Subject to any disclaimer, the term of this patent is extended or adjusted under 35 U.S.C. 154(b) by 0 days.

(21) Appl. No.: 12/966,100

(22) Filed: Dec. 13, 2010

(65) Prior Publication Data

US 2011/0079745 A1 Apr. 7, 2011

Related U.S. Application Data

(62) Division of application No. 11/578,291, filed as application No. PCT/EP2005/004540 on Apr. 28, 2005, now abandoned.

(30) Foreign Application Priority Data

Apr. 29, 2004 (DE) ..... 10 2004 021 092

(51) Int. Cl.

| | |
|---|---|
| ***D06M 11/79*** | (2006.01) |
| ***D06M 15/356*** | (2006.01) |
| ***D06M 15/41*** | (2006.01) |
| ***D06M 15/61*** | (2006.01) |
| ***C09C 1/30*** | (2006.01) |

(52) U.S. Cl. ..... 252/8.81; 252/8.61; 252/8.82; 252/8.83; 252/8.84; 252/8.85; 252/8.86; 252/8.91; 26/1; 427/387; 427/389.9

(58) Field of Classification Search ..... 252/8.61, 252/8.81, 8.82, 8.83, 8.84, 8.85, 8.86, 8.91; 26/1; 427/387, 389.9

See application file for complete search history.

(56) References Cited

U.S. PATENT DOCUMENTS

| | | | | |
|---|---|---|---|---|
| 6,905,632 | B2 | 6/2005 | Lortz et al. | |
| 7,015,270 | B2 | 3/2006 | Scharfe et al. | |
| 7,491,375 | B2 * | 2/2009 | Schumacher et al. | 423/335 |
| 7,790,238 | B2 * | 9/2010 | Keller et al. | 427/412 |
| 2007/0043124 | A1 | 2/2007 | Brandes et al. | |
| 2007/0055009 | A1 * | 3/2007 | Hasenzahl et al. | 524/588 |
| 2008/0300356 | A1 * | 12/2008 | Meyer et al. | 524/493 |
| 2009/0298982 | A1 * | 12/2009 | Meyer et al. | 524/268 |

FOREIGN PATENT DOCUMENTS

| | | |
|---|---|---|
| DE | 195 34 327 | 2/1996 |
| EP | 1 013 605 | 6/2000 |
| EP | 1 331 254 | 7/2003 |
| JP | 2001-89981 | 4/2001 |
| WO | 2004/018359 A1 | 3/2004 |
| WO | 2004-050377 | 6/2004 |

* cited by examiner

*Primary Examiner* — Anthony J Green

(74) *Attorney, Agent, or Firm* — Oblon, Spivak, McClelland, Maier & Neustadt, L.L.P.

(57) ABSTRACT

An aqueous dispersion for use as a finishing agent for textiles, wherein the dispersion contains a pyrogenically produced, aggregated silicon dioxide powder and a cationic polymer which is soluble in the dispersion, wherein the cationic polymer is present in a quantity such that the particles of the silicon dioxide powder exhibit a positive zeta potential.

12 Claims, No Drawings

USE OF A CATIONIC SILICON DIOXIDE DISPERSION AS A TEXTILE FINISHING AGENT

This is a divisional application of U.S. application Ser. No. 11/578,291, filed Oct. 13, 2006, now abandoned, which is a 371 of PCT/EP05/004540 filed on Apr. 28, 2005.

The invention relates to a cationic silicon dioxide dispersion for use as a textile finishing agent.

It has long been known to use silica as an non-slip agent for textiles (Ullmann's Encyclopedia of Industrial Chemistry, Vol. A26, p. 328, 5th edition). These silica sols may have specific surface areas of more than 1000 $m^2/g$. They generally assume the form of isolated, spherical particles with diameters of a few nanometers. In order to prevent gelation, they are generally stabilised by the addition of aluminium salts or polymers. In the case of use as an non-slip agent, it has proved disadvantageous that, in order to achieve the desired effect of slip resistance, it is sometimes necessary to use large quantities of silica sol or cationised silica sol. This is possibly due to the spherical structure of the silica sol particles. Better results may be obtained with partially aggregated silica sol particles, as described in WO 2004/007367. The low degree of aggregation of the silica sol particles is disadvantageous here. Furthermore, the bond between the silica sol particles is not so strong that the energy introduced in the event of any external force applied to the particles is sufficient to separate the aggregates again.

The object of the present invention is to provide a dispersion containing silicon dioxide which may be used as a textile finishing agent and avoids the disadvantages of the prior art.

The present invention provides an aqueous dispersion for use as a finishing agent for textiles, wherein the dispersion contains a pyrogenically produced, aggregated silicon dioxide powder and a cationic polymer which is soluble in the dispersion, wherein the cationic polymer is present in a quantity such that the particles of the silicon dioxide powder exhibit a positive zeta potential.

Pyrogenically produced silicon dioxide powders should be taken to mean those which are obtainable by flame hydrolysis or flame oxidation. In these processes, primary particles of approx. 5 to 50 nm are initially formed, which, as the reaction proceeds, combine to form aggregates. These aggregates form a three-dimensional network. The aggregates cannot generally be broken back down into the primary particles.

The specific surface area of the pyrogenically produced silicon dioxide powder in the aqueous dispersion is not limited. It may preferably have a specific surface area of 50 to 300 $m^2/g$.

A preferred dispersion may be one in which the pyrogenically produced silicon dioxide powder is doped with up to 1 wt. % of aluminium oxide or potassium. Such powders are described, for example, in EP-A-995718 and EP-A-1216956.

The content of pyrogenically produced silicon dioxide powder in the dispersion may preferably amount to 3 to 50 wt. %.

Selection of the cationic polymer is not limited according to the present invention, but the quantity thereof is. The cationic polymers must be present in the dispersion in a quantity such that the surface of the particles of the silicon dioxide powder is completely covered with cationic polymer and consequently exhibits a positive zeta potential.

The content of cationic polymer is preferably between 0.1 and 15 wt. % and particularly preferably between 0.8 and 5 wt. %, relative to the quantity of cationic polymer and silicon dioxide powder.

Cationic polymers with a molecular weight of less than 100000 g/mol are preferred.

Preferred cationic polymers may be: polymers with at least one quaternary ammonium group, a phosphonium group, an acid adduct of a primary, secondary or tertiary amine group, a polyethyleneimine, a polydiallylamine or a polyallylamine, a polyvinylamine, a dicyandiamide condensation product, a dicyandiamide-polyamine cocondensation product, a polyamide-formaldehyde condensation product.

Preferred polymers may be those based on a diallyl ammonium compound, particularly preferably those based on a dialkyldiallyl compound which may be obtained by a free-radical cyclisation reaction of diallylamine compounds and exhibit structure 1 or 2. Structures 3 and 4 represent copolymers based on dialkyldiallyl compounds.

In these structures, $R_1$ and $R_2$ represent a hydrogen atom, an alkyl group with 1 to 4 C atoms, methyl, an ethyl, an n-propyl, an iso-propyl, an n-butyl-, an iso-butyl or a tert.-butyl group, wherein $R_1$ and $R_2$ may be identical or different. A hydrogen atom of the alkyl group may furthermore be substituted by a hydroxy group. Y represents a free-radically polymerisable monomer unit, such as for example sulfonyl, acrylamide, methacrylamide, acrylic acid or methacrylic acid. $X^-$ represents an anion.

A poly(diallyldimethyl ammonium chloride) solution (PDADMAC solution in water) may be mentioned by way of example.

1

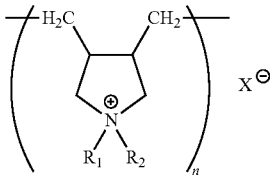

2

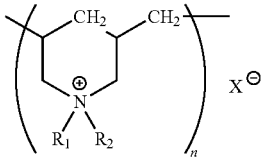

3

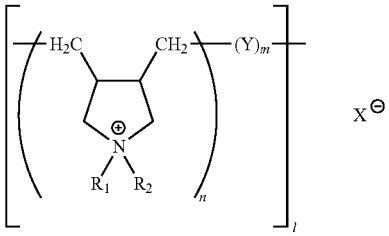

4

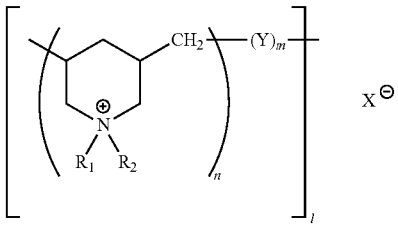

The aggregate size of the silicon dioxide particles is not limited, but may preferably be smaller than 0.5 μm. At this size it is, for example, possible to influence the handle and lustre of the textiles.

The pH value of the dispersion may preferably be between 2 and 8.

The dispersion may, for example, be produced as described in EP-A-1013605 or EP-A-1331254.

The dispersion exhibits the advantage over prior art dispersions containing silica sols which are either not aggregated or may be present in partially aggregated form so that less silicon dioxide need be used in order to bring about, for example, the same slip resistance in the textiles. Additionally, the aggregate size of the particles and thus the handle and lustre of the textiles may be adjusted by suitable dispersion techniques. The advantages are probably attributable to the aggregated structure of the pyrogenically produced silicon dioxide powder.

EXAMPLES

Cationic Silica-Dispersion According to the Invention (DI)

24.38 g Polyquat 40U05NV (40% PDADMAC solution in water, molecular weight ca 5000 g/mol, Katpol GmbH, Bitterfeld) is dissolved in 800 g desalinated water. This mixture is gradually incorporated into 600 g silicon dioxide powder doped with 0.25 wt. % aluminium oxide using a dissolver. Sufficient water is then added to achieve a solids content of 41%. This is then dispersed for 30 min at 7000 rpm. The pH value of the dispersion is 2.8, the viscosity 28 mPas at 1/s. The zeta potential is measured as +42 mV by CVI. The isoelectrical point is at pH 10.1.

Cationic Silica-Dispersion (Reference Dispersion According to the State of the Art) (DII)

Durasol® 5071, Cognis: 25 wt-% cationic, colloidal silica dispersion.

Foulard-Process: The dispersion DI and DII are contacted with a viscose (Application A1) or a polyester textile (Application A2) using a Foulard-process.

The liquor compositions for A1 comprises 100 g/l STABITEX ETR, 6.1 g/l D1 respectively 15 g/l DII, 30 g/l ADASIL SM, 20 g/l ADALIN NI, 20 g/l $MgCl_2$, 1.0 g/l FORYL 100. The pH of the liquor is <5.5, the liquor pick-up is 100%, the application is dry/wet, temperature for drying is 110° C. and condensation takes 3 minutes at 150° C.

STABITEX, DURASOL, ADASIL, ADALIN and FORYL are all trademarks of Cognis.

The liquor composition for A2 is 22 g/l D1 respectively 45 g/l DII. The pH of the liquor is <5.5, the liquor pick-up is 20%, the application is wet/wet, temperature for drying is 110° C.

In the applications A1 as well as A2 a significant less amount of the dispersion DI compared to state of the art dispersion DII suffice to give the same non-slip effect as measured according DIN 53 934.

The invention claimed is:

1. A process comprising applying an aqueous dispersion as a finishing agent to a textile, wherein the dispersion comprises a pyrogenically produced, aggregated silicon dioxide powder and a cationic polymer which is soluble in the dispersion, wherein the cationic polymer is present in a quantity such that the particles of the silicon dioxide powder exhibit a positive zeta potential.

2. The process according to claim 1, wherein the pyrogenically produced silicon dioxide powder has a specific surface area of 50 to 300 $m^2/g$.

3. The process according to claim 1, wherein the pyrogenically produced silicon dioxide powder is doped with up to 1 wt. % of aluminium oxide or potassium.

4. The process according to claim 1, wherein the dispersion has a content of silicon dioxide powder of 3 to 50 wt. %.

5. The process according to claim 1, wherein the dispersion has a content of cationic polymer of between 0.1 wt. % and 15 wt. %, relative to the quantity of cationic polymer and silicon dioxide powder.

6. The process according to claim 1, wherein the cationic polymer has a molecular weight of less than 100000 g/mol.

7. The process according to claim 1, wherein the cationic polymer is a polymer with at least one quaternary ammonium group or a phosphonium group, an acid adduct of a primary, secondary or tertiary amine group, a polyethyleneimine, a polydiallylamine or a polyallylamine, a polyvinylamine, a dicyandiamide condensation product, a dicyandiamide-polyamine cocondensation product, or a polyamide-formaldehyde condensation product.

8. The process according to claim 1, wherein the aggregate size in the dispersion is less than 0.5 μm.

9. The process according to claim 1, wherein the pH value of the dispersion is between 2 and 8.

10. The process according to claim 1, wherein the cationic polymer is based on a diallyl ammonium compound.

11. The process according to claim 10, wherein the diallyl ammonium compound is a dialkyldiallyl compound obtained by a free-radical cyclisation reaction of a diallylamine compound and exhibits the following structure 1 or 2:

1

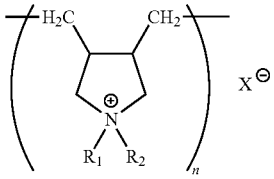

2

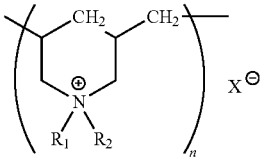

wherein $R_1$ and $R_2$ may be identical or different and represent a hydrogen atom, or an alkyl group with 1 to 4 C atoms, and wherein a hydrogen atom of the alkyl group may be substituted by a hydroxy group, and $X^-$ represents an anion.

12. The process according to claim 10, wherein the diallyl ammonium compound is a copolymer based on a dialkyldiallyl compound obtained by a free-radical cyclisation reaction of a diallylamine compound and a compound copolymerizable therewith and exhibits the following structure 3 or 4:

3

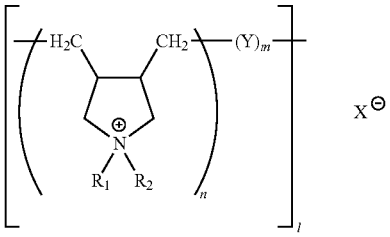

4

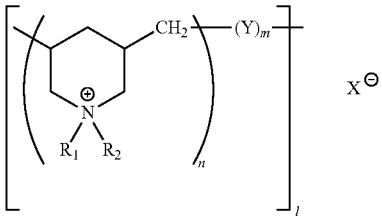

wherein $R_1$ and $R_2$ may be identical or different and represent a hydrogen atom, or an alkyl group with 1 to 4 C atoms, and wherein a hydrogen atom of the alkyl group may be substituted by a hydroxy group, Y represents a free-radically polymerisable monomer unit, and $X^-$ represents an anion.

* * * * *